US006080710A

United States Patent [19]

Withenshaw et al.

[11] Patent Number: 6,080,710

[45] **Date of Patent: *Jun. 27, 2000**

[54] BLEACH ACTIVATOR COMPOSITIONS

[75] Inventors: John David Withenshaw; Mark Alexander France, both of Clwyd, United Kingdom

[73] Assignee: Warwick International Group Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/640,928

[22] PCT Filed: Nov. 16, 1994

[86] PCT No.: PCT/GB94/02520

§ 371 Date: May 3, 1996

§ 102(e) Date: May 3, 1996

[87] PCT Pub. No.: WO95/14077

PCT Pub. Date: May 26, 1995

[30] Foreign Application Priority Data

Nov. 16, 1993 [GB] United Kingdom ..... 9323634

[51] Int. Cl.[7] ..... C11D 7/54

[52] U.S. Cl. ..... 510/312; 510/309; 510/372; 510/375; 510/376; 510/445; 510/475; 252/186.25; 252/186.41

[58] Field of Search ..... 510/303, 309, 510/312, 372, 375, 376, 445, 475; 252/186.27, 186.28, 186.26, 186.29, 186.25, 186.41; 427/213.34, 213.3

[56] References Cited

U.S. PATENT DOCUMENTS

| | | | |
|---|---|---|---|
| 3,943,063 | 3/1976 | Morishita et al. | 427/213.36 |
| 4,777,089 | 10/1988 | Takizawa et al. | 427/213.3 |
| 5,000,869 | 3/1991 | Dittert | 252/186.34 |
| 5,141,664 | 8/1992 | Corring et al. | 510/370 |
| 5,324,445 | 6/1994 | Langley et al. | 510/321 |
| 5,434,069 | 7/1995 | Tsaur et al. | 435/188 |
| 5,441,660 | 8/1995 | Tsaur et al. | 510/372 |
| 5,460,817 | 10/1995 | Langley et al. | 424/108 |
| 5,492,646 | 2/1996 | Langley et al. | 510/530 |

FOREIGN PATENT DOCUMENTS

| | | |
|---|---|---|
| 0560506 | 4/1983 | Australia . |
| 0092932 | 11/1983 | European Pat. Off. . |
| 0106634 | 4/1984 | European Pat. Off. . |
| 0098129 | 11/1984 | European Pat. Off. . |
| 0125781 | 11/1984 | European Pat. Off. . |
| 0126528 | 11/1984 | European Pat. Off. . |
| 0128661 | 12/1984 | European Pat. Off. . |
| 0140648 | 5/1985 | European Pat. Off. . |
| 0238341 | 9/1987 | European Pat. Off. . |
| 0256343 | 2/1988 | European Pat. Off. . |
| 0294904 | 12/1988 | European Pat. Off. . |
| 0331300 | 9/1989 | European Pat. Off. . |
| 0332294 | 9/1989 | European Pat. Off. . |
| 0356239 | 2/1990 | European Pat. Off. . |
| 0382464 | 8/1990 | European Pat. Off. . |
| 0385522 | 9/1990 | European Pat. Off. . |
| 0435379 | 7/1991 | European Pat. Off. . |
| 0468824 | 1/1992 | European Pat. Off. . |
| 3304848 | 8/1984 | Germany . |
| 3545803 | 7/1986 | Germany . |
| 0864798 | 4/1961 | United Kingdom . |
| 1147871 | 4/1969 | United Kingdom . |
| 1275712 | 5/1972 | United Kingdom . |
| 1475229 | 6/1977 | United Kingdom . |
| 1482515 | 8/1977 | United Kingdom . |
| 1507739 | 4/1978 | United Kingdom . |
| 2001083 | 1/1979 | United Kingdom . |
| 2002400 | 2/1979 | United Kingdom . |
| 93/06203 | 4/1993 | WIPO . |

*Primary Examiner*—Caroline D. Liott
*Attorney, Agent, or Firm*—Morgan & Finnegan, L.L.P.

[57] ABSTRACT

A process for making a coated bleach component which may be incorporated into a detergent composition comprising hydrogen peroxide solution. The process includes the steps of dispersing the bleach component in a continuous liquid phase to form discrete islands of dispersed phase and subsequently forming a polymeric coating at the interface between the dispersed phase and the continuous phase. The coating formed is resistant to hydrogen peroxide solution and is removable when the liquid continuous phase is diluted with aqueous wash liquor. In this way particulate material which reacts with hydrogen peroxide can be incorporated into an aqueous detergent liquid which contains dissolved hydrogen peroxide, whilst maintaining stability.

10 Claims, No Drawings

BLEACH ACTIVATOR COMPOSITIONS

The present invention relates to detergent compositions, generally comprising bleach activator in which a detergent component, generally the bleach activator, is protected from its environment by a polymeric shell, of particular utility in liquid laundry detergents. Processes for making the composition are also described.

Laundry detergents conventionally contain a bleaching species. Chlorine bleaches are used in some instances, but peroxygen bleaches are in general preferred. Peroxygen bleaches include hydrogen peroxide itself, percarboxylic acids and inorganic persalts such as sodium perborate, percarbonate or persulphate. The inorganic persalts tend not to release the peroxygen bleaching species at low temperatures and it is conventional therefore to incorporate into the detergent liquor a bleach activator compound. Such compounds are generally N-acyl or O-acyl compounds which act as acyl donors in aqueous solution and which react with the bleach precursor (or bleach donor) compound to form a percarboxylic acid in situ.

The chemical reaction which takes place between the bleach precursor and the bleach activator compound is likely to take place whenever the two ingredients come into contact with one another in the presence of water. In order to avoid the premature reaction of the two species during storage of the detergent composition they therefore need to be kept separate from one another. Other components of the wash liquor also need to be kept separate from the bleach components to prevent degradation by those components during storage.

Various ways of rendering detergent components storage stable have been proposed. For bleach activators which are solids at room temperature it is usual for particulate activator to be granulated so that the activator particles are dispersed in a polymeric matrix to form granules. Granulating binders may be synthetic or natural polymers or their derivatives or mixtures of these. In general the binder should be soluble in alkaline wash liquor environments. Methods of granulating activators such as tetraacetyl ethylene diamine are described in our earlier specifications nos. EP-A-0,238,341 and EP-A-0,468,824.

Other ways of formulating bleach activators, including activators which are liquid at room temperature involve formulating them with molten surfactants, especially anionic and nonionic surfactants or fatty acids or poly(alkylene oxy) polymers. The activator may be formulated by spraying molten binder onto a moving bed of particulate bleach activator, by making a blend of molten binder and bleach activator and then shaping it, for instance by spray cooling, extrusion and chopping, or bleach activator may be granulated using inorganic binders, such as polyphosphate compounds.

There is a particular difficulty in formulating bleach activator in a form which will be storage stable in a liquid laundry detergent composition. Although suggestions have been made to incorporate bleach activator compositions into liquid detergents, the storage stability tends to be inadequate, the activator reacting prematurely with the bleach precursor to form oxygen gas in the container. In EP-A-0,385,522 a liquid laundry detergent with improved storage stability is described. The stability is estimated by determining the volume increase due to formation of gas bubbles. The storage stability is said to be achieved by structuring the liquid continuous phase. In that specification it is also proposed to encapsulate bleach particles as described in EP-A-0,294,904. It is also suggested to load the continuous liquid phase of the liquid detergents with electrolyte and to maintain a relatively low pH in the composition. The bleach precursor was either hydrogen peroxide, in solution in the continuous phase, or sodium perborate mono- or tetra-hydrate. None of the specific examples contained bleach activator.

In EP-A-0,356,239 and the CIP of the corresponding U.S. application, U.S. Pat. No. 5,324,445, there are described ways of formulating enzymes for inclusion in liquid detergent concentrates.

In EP-A-0,382,464 discloses a process for coating or encapsulating solid particles and/or droplets consisting of peroxygen bleach component with a polymeric coating by the solidification of a melt made of said polymeric coating material.

In a new process for making a coated bleach component according to the present invention comprises the steps of dispersing the bleach component in a continuous liquid phase to form discrete islands of dispersed phase and then forming a polymeric coating at the interface between the dispersed phase and the continuous phase, the coating being resistant to hydrogen peroxide and being removable when the continuous liquid phase is diluted with aqueous wash liquor.

The bleach component used in the process of the invention may either comprise one or a mixture of more than one of bleach precursors, for instance peroxygen bleach precursors such as inorganic persalts, or a percarboxylic bleaching species, such as peracetic acid, perbenzoic acid, di- or mono-perphthalic acid or mono- or di-percarboxylic derivatives of aliphatic dibasic carboxylic acids, or a bleach activator. The invention is particularly useful where the bleach component is a percarboxylic acid bleaching species or a bleach activator. Most preferably, however, the bleach component is a bleach activator.

The bleach activator may be any of the N- or O-acyl compounds conventionally used as bleach activators.

Preferably the activator is a compound of the formula I:

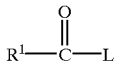

I n which L is a leaving group attached via an oxygen or a nitrogen atom to the C═O carbon atom and $R^1$ is an alkyl, aralkyl, alkaryl, or aryl group, any of which groups has up to 24 carbon atoms and may be substituted or unsubstituted.

The leaving group L is preferably a compound the conjugate acid of which has a $pK_a$ in the range 4 to 13, preferably 7 to 11, most preferably 8 to 11.

It is preferred that $R^1$ is an aliphatic group preferably a $C_{1-18}$ alkyl group, or an aryl group.

In the present invention the term alkyl includes alkenyl and alkyl groups may be straight, branched or cyclic.

In the formula I, L and $R^1$ may be joined to form a cyclic compound, usually a lactone or a lactam. These cyclic groups may include heteroatoms, for instance oxygen or optionally substituted nitrogen atoms, carboxyl groups as well as —$CH_2$— groups or substituted derivatives thereof. They may be saturated or unsaturated. L can itself comprise a cyclic group, including heterocyclic groups, for instance joined to the C═O group of the compound I via the heteroatom.

Substituents on $R^1$ and L can include hydroxyl, ═N—$R^2$ in which $R^2$ is selected from any of the groups represented by $R^1$ and is preferably lower alkyl, amine, acyl, acyloxy, alkoxy, aryl, aroyl, aryloxy, aroyloxy, halogen, amido, and imido groups and the like as well as other groups not adversely affecting the activity of the compound.

In the invention the compound of the formula I can be any N-acyl or O-acyl acyl-donor compound, which has been described as a bleach activator for use in laundry detergents. The compound of the formula I may be an anhydride, but is preferably an ester or, even more preferably, an amide derivative.

Amide derivatives include acyl imidazolides and N,N-di acylamides, such as TAED. Other examples of N-acyl derivatives are:

a) 1,5-diacetyl-2,4-dioxohexahydro-1,3,5-triazine (DADHT);
b) N-alkyl-N-suphonyl carbonamides, for example the compounds N-methyl-N-mesyl acetamide, N-methyl-N-mesyl benzamide, N-methyl-N-mesyl-p-nitrobenzamide, and N-methyl-N-mesyl-p-methoxybenzamide;
c) N-acylated cyclic hydrazides, acylated triazoles or urazoles, for example monoacetyl maleic acid hydrazide;
d) O,N,N-trisubstituted hydroxylamines, such as O-benzoyl-N,N-succinyl hydroxylamine, O-p-nitrobenzoyl-N,N-succinyl hydroxylamine and O,N,N-triacetyl hydroxylamine;
e) N,N'-diacyl sulphurylamides, for example N,N'-dimethyl-N,N'-dimethyl-N,N'-diacetyl sulphuryl amide and N,N'-diethyl-N,N'-dipropionyl sulphurylamide;
f) 1,3-diacyl-4,5-diacyloxy-imidazolines, for example 1,3-diformyl-4,5-diacetoxy imidazoline, 1,3-diacetyl-4,5-diacetoxy imidazoline, 1,3-diacetyl-4,5-dipropionyloxy imidazoline;
g) Acylated glycolurils, such as tetraacetyl glycoluril and tetraproprionyl glycoluril;
h) Diacylated 2,5-diketopiperazines, such as 1,4-diacetyl-2,5-diketopiperazine, 1,4-dipropionyl-2,5-diketopiperazine and 1,4-dipropionyl-3,6-dimethyl-2,5-diketopiperazine;
i) Acylation products of propylene diurea and 2,2-dimethyl propylene diurea, especially the tetraacetyl or tetrapropionyl propylene diurea and their dimethyl derivatives;
j) Alpha-acyloxy-(N,N')polyacyl malonamides, such as alpha-acetoxy-(N,N')-diacetyl malonamide.
k) O,N,N-trisubstituted alkanolamines, such as O,N,N-triacetyl ethanolamine.
k') Cyanamides, such as those disclosed in DE-A-3,304,848.
l) N-acyl lactams, such as N-benzoyl caprolactam, N-acetyl caprolactam, the analogous compounds formed from $C_{4-10}$ lactams.
m) N-acyl and N-alkyl derivatives of substituted or unsubstituted succinimide, phthalimide and of imides of other dibasic carboxylic acids, having 5 or more carbon atoms in the imide ring.

Alternatively the compound may be an ester, for instance n) sugar esters, such as pentaacetylglucose,
o) esters of imidic acids such as ethyl benzimidate,
p) triacylcyanurates, such as triacetylcyanurate and tribenzoylcyanurate,
q) esters giving relatively surface active oxidising products for instance of $C_{8-18}$-alkanoic or -aralkanoic acids such as described in GB-A-864798, GB-A-1147871 and the esters described in EP-A-98129 and EP-A-106634, for instance compounds of the formula I where L comprises an aryl group having a sulphonic acid group (optionally salified) substituted in the ring to confer water solubility on a benzyl group, especially nonanoyloxy-benzenesulphonate sodium salt (NOBS), isononanoyloxy-benzenesulphonate sodium salt (ISONOBS) and benzoyloxy-benzenesulphonate sodium salt (BOBS)
r) phenyl esters of $C_{14-22}$-alkanoic or -alkenoic acids,
s) esters of hydroxylamine,
t) geminal diesters of lower alkanoic acids and gem-diols, such as those described in EP-A-0125781 especially 1,1,5-triacetoxypent-4-ene and 1,1,5,5-tetraacetoxypentane and the corresponding butene and butane compounds, ethylidene benzoate acetate and bis (ethylidene acetate) adipate and
u) enol esters, for instance as described in EP-A-0140648 and EP-A-0092932.

Where the activator is an anhydride it is preferably a solid material, and is preferably an intra-molecular anhydride, or a polyacid polyanhydride. Such anhydride compounds are more storage stable than liquid anhydrides, such as acetic anhydride. Anhydride derivatives which may be used as activator include v) intramolecular anhydrides of dibasic carboxylic acids, for instance succinic, maleic, adipic, phthalic or 5-norbornene-2,3-dicarboxylic anhydride,
w) intermolecular anhydrides, including mixed anhydrides, of mono- poly-basic carboxylic acids, such as diacetic anhydride of isophthalic or perphthalic acid
x) isatoic anhydride or related compounds such as described in EP-A-332294 having the generic formula II (II)

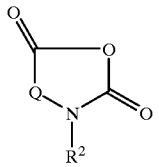

wherein Q is a divalent organic group such that Q and N together with the carbonyl groups and oxygen atom of the anhydride group form one or more cyclic structures and $R^2$ is H, alkyl, aryl, halogen or a carbonyl group of a carboxyl containing function; or benzoxazin-4-ones as described in EP-A-331300, that is compounds of the formula III (III)

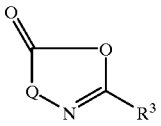

wherein Q' is selected from the same groups as Q and $R^3$ is H, alkyl, aryl, alkaryl, aralkyl, alkoxyl, haloalkyl, amino, aminoalkyl, carboxylic group or a carbonyl-containing function; preferably 2-methyl-(4H)3,1-benzoxazin-4-one (2MB4) or 2-phenyl-(4H)3,1-benzoxazin-4-one (2PB4);

y) polymeric anhydrides such as poly(adipic) anhydride or other compounds described in our co-pending application WO -A-9306203.

In the process of the invention the polymeric coating formed at the interface between the continuous and the dispersed phase is generally formed by coacervation of two or more coacervating polymers. Alternative methods of forming the coating can be described as encapsulation (or micro encapsulation) techniques for example, azeotroping or in situ polymerisation.

The continuous phase may be aqueous or non-aqueous. The dispersed phase may consist of solid particles dispersed in the continuous phase or, more usually, includes a liquid which is immiscible with the continuous phase. Where the dispersed phase contains a liquid, the bleach component may be dissolved or suspended as particulate matter in the dispersed phase.

Where the dispersed phase comprises a solid it may comprise the bleach component bound or encapsulated in a polymeric matrix. Particularly preferred polymeric matrices for forming the dispersed phase include polyacrylate polymers.

The polymer binding or encapsulating the bleach component will generally take part in the subsequent encapsulation step, for example, either by coacervation with secondary polymeric materials in the continuous phase or by forming anchor sites onto which secondary polymer and/or cross-linking materials may be added.

Since bleach species tend to be soluble in aqueous liquids, it is usual for the continuous phase to be a non-solvent for the bleach component and thus to be a water-immiscible liquid. The bleach component is generally present in the dispersed phase which includes also aqueous liquid. Although the bleach component may be dissolved, it is generally preferred for the dispersed phase to have as high a concentration as possible of the bleach component and as low a concentration as possible of water, since it may be desirable to remove most or all of the water in subsequent processing steps, and the dispersed phase may therefore include bleach component at a concentration above the solubility level for the bleach component. The bleach component is generally therefore present as suspended particles in the aqueous dispersed phase.

The two-phase mixture which is used in the process of the invention is generally made by adding the components which form the dispersed phase to the liquid which forms the continuous phase. Where the dispersed phase is in liquid form, it is usual for the components of the dispersed phase to be preformed as a dispersion in the liquid. The liquid may include other components which stabilise the liquid before the dispersion is formed, or which serve to stabilise the dispersion, which stabilise the product composition, or a detergent into which the product is incorporated. The liquid may also contain components which are active in the final detergent liquor.

Components which stabilise the liquid are, for instance, thickeners, suspending agents, or dispersing agents. Thickeners may be soluble polymeric compounds or may be particulate materials which structure the liquid. Components which stabilise the two-phase dispersion may be polymeric stabilisers including pendant groups which result in the stabiliser being concentrated at the interface between the two phases, that is hydrophilic and lipophilic groups. Such components may also stabilise the product suspension and/or a liquid detergent concentrate into which the product is incorporated.

Components which are active in the detergent liquor include, for instance, bleach catalysts, such as manganese compounds, bleach stabilisers, such as sequestrants, preferably low molecular weight water-soluble anionic polymers, especially acrylate-maleic copolymers, or, most preferably, poly(methylene phosphonic acid) compounds such as ethylene diamine tetra (methylene phosphonic acid) and its salts, diethylene triamine penta(methylene phosphonic acid) and its salts. Other sequestrants include polycarboxylic acids such as ethylene diamine tetra acetic acid and nitrilotriacetic acid (NTA).

The liquid which is to form the dispersed phase in the process may also contain one of the ingredients used to form the polymeric coating. For instance where the polymeric coating comprises a coacervate of two or more polymeric species, the dispersed phase may contain one of these species. Alternatively the polymeric coating may be formed by polymerisation in situ at the interface and the liquid phase used to form the dispersed phase may therefore include components for that polymerisation reaction. Such components may be monomeric species, prepolymer species with polymerisable groups or components of the initiation system. Where the polymeric coating is formed by polymerisation in situ, polymerisation may be initiated for example, by the addition of a catalyst for the polymerisation reaction, either in the dispersed phase or in the continuous phase prior to formation of the dispersion, or after formation of the dispersion. In particular acid catalysed polymerisation may be used, so that polymerisation may be initiated by acidification. Preferably acidification will be by addition of acid to the two phase dispersion. Particularly preferred acids for the acidification are organic acids.

The two phase mixture used in the process of the present invention is made by dispersing components for forming the dispersed phase into the liquid forming the continuous phase, optionally in the presence of suitable emulsifiers and/or stabilisers and using suitable equipment so as to form dispersed phase having the desired particle size. Where the dispersed phase is in liquid form, the particles generally have a size in the range 0.1 to 2000 $\mu$m, preferably 1 to 500 $\mu$m, for instance around 2 to 50 $\mu$m.

A dispersion stabiliser which can be used to stabilise the two-phase mixture is preferably an amphipathic polymeric stabiliser, that is to say a polymeric stabiliser having hydrophobic and hydrophilic components as a result of having been made from hydrophobic and hydrophilic monomers. The stabiliser concentrates at the interface and can accordingly serve as part of the components forming the polymeric coating of the product. Where an emulsifier is included in the mixture, the emulsifier itself may also contribute to the coating of the product.

A particularly preferred combination of stabilising components comprises emulsifier and/or polymeric stabiliser, preferably both. The preferred emulsifiers include those having a HLB (hydrophilic-lipophilic balance) of from 3 to 6. The choice of emulsifier may be affected by the continuous phase used. A particularly preferred emulsifier is Synperonic A3 (trade name of ICI).

Particularly preferred polymeric stabilisers have been found to be polyethyleneglycol-1000-monostearate and sodium trioleate (available under the trade name Span 85 from ICI).

Where used, the amount of emulsifier and/or polymeric stabiliser will be sufficient to form a stable emulsion in the continuous phase. It will generally be no greater than 10% by weight of the two-phase mixture. Preferably it will be at least 0.05%, or even at least 0.1% and no greater than 8%, most preferably no greater than 6%.

Water immiscible liquids which are suitable for the continuous phase include low molecular weight (such as no greater than 500) alkenes, ethers or halogenated alkanes. Preferably the water immiscible liquid will form an azeotrope with water. Specific examples include toluene, petroleum ether and dichloromethane. Particularly preferred water immiscible liquids are petroleum ethers having a high boiling point, preferably in the range 100 to 120° C.

The ratio of water immiscible liquid to dispersed phase, generally aqueous liquid, for forming the dispersion will preferably be from 5:1 to 1.1:1 and most preferably from 5:1 to 2:1.

Other suitable surfactants (emulsifiers), polymeric stabilisers and water-immiscible liquids useful as the continuous phase are described in EP-A-0,128,661 and EP-A-0,126,528, with further descriptions of stabilisers being in GB-A-2,002,400, GB-A-2,001,083 and GB-A-1,482,515.

The polymeric coating generally forms a shell around the bleach component and is generally made by coacervation. Coacervation techniques are known for encapsulating a variety of materials and are described in, for instance, GB-A-1,275,712, GB-A-1,475,229, GB-A-1,507,739 and DE-A-3,545,803. Since coacervation generally takes place in a continuous aqueous phase, it is necessary to form an oil-in-water dispersion in which the dispersed oil phase contains the bleach component. The dispersion of bleach component into the water immiscible phase may be carried out by direct suspension of the bleach component into the oil phase, in which it is usually insoluble. The suspension may include suspending/dispersing agents and/or thickening agents to maintain a stable suspension. The suspension may be formed by first forming a water-in-oil suspension or emulsion of aqueous phase containing the bleach component into the water-immiscible liquid and, optionally, subsequently drying the dispersion to remove aqueous phase. Such drying may be conducted by distilling under reduced pressure to remove a mixture of water and the liquid of the continuous phase, a technique often known as azeotropic distillation or by other drying techniques, such as spray drying. Where the bleach component is water soluble, preferably the drying technique used should be sufficiently rapid that dissolution of the bleach component is limited. Drying in this way enables the formation of dry particles comprising bleach component and a first polymer for coacervation, which can form the dispersed phase.

Coacervation is then conducted by dispersing the oil phase into an aqueous phase containing components of the coacervation reaction.

Coacervating polymers may be counterionic, that is one of the components is generally anionic (but may have some cationic groups, that is, it may be amphoteric) and the other polymer is generally cationic (but may have a proportion of anionic groups, thus being amphoteric). In order to prevent premature interaction of the counterionic polymers, it is usual for each of them to be dissolved in a separate aqueous mixture and to add these two mixtures independently to the dispersion in which coacervation takes place.

The dispersion of dispersed phase in continuous phase may be formed from two polymers which do not coacervate under conditions of mixing, coacervation subsequently being initiated by the incorporation of a coacervation catalyst. For example, coacervation may be initiated by adding acid to the two phase mixture to change the ionicity of one of the polymers.

Once coacervation by ionic attraction between the counterionic groups in the two or more polymers, have taken place at the interface between the continuous aqueous phase and the dispersed oil phase, it may be desirable for the coating to be subsequently crosslinked, for instance by forming covalent bonds between the polymeric chains. This crosslinking may help to physically stabilise the coating and may help to render it more resistant to permeation of bleach components out of the encapsulated product or other components into the encapsulated bleach during storage of the detergent composition into which the product is incorporated. Further crosslinking may, for instance, be achieved by providing ethylenically unsaturated groups on both the component polymers of the coacervating mixture and initiating an addition polymerisation, for instance by incorporating radical forming initiators. Other covalent crosslinking reactions may be achieved by providing reactive pendant groups and, optionally, linking reagents for interacting with such pendant groups in a subsequent reaction. Suitable crosslinking agents include polyvinyl pyrrolidone, urea, melamine, formaldehyde, melamine formaldehyde and urea formaldehyde resins.

Polymers suitable for use in coacervation processes preferably include a low molecular weight cationic polymer and a relatively high molecular weight anionic polymer. The cationic polymer should generally have a molecular weight below 100,000, more preferably below 50,000 and often below 10,000. The anionic polymer normally has a molecular weight above 100,000, more often above 200,000 and preferably above 500,000, for instance up to 1–2,000,000, though higher molecular weight can sometimes be used. In another preferred aspect of the invention a relatively low molecular weight anionic polymer is used in combination with a relatively high molecular weight cationic polymer.

Suitable cationic polymers include cationic urea formaldehyde polymers, polyimines and, preferably, polymers of acrylate monomers including cationic, usually quaternary ammonium, groups. Such cationic monomers are, for instance, quaternary ammonium derivatives of alkyl acrylate esters or N-alkyl (meth)acrylamides, Mannich reaction products of an aldehyde, an amine and (meth)acrylamide or diallyl dimethyl ammonium chloride. Anionic polymers are, for instance, polymers formed from anionic ethylenically unsaturated monomers, including sulphonic acid monomers or, more preferably, carboxylic acid group containing monomers such as (meth)acrylic acid. Both types of polymer preferably contain non-ionic comonomer units, especially (meth)acrylamide.

In the coacervation process it is preferred to use to a stoichiometric excess of one of the polymers over the other. In this way the surface of the coated particles will have an overall positive or negative charge. Similarly charged particles, in aqueous dispersion, will repel one another and tend, therefore, to remain in dispersion. It is preferable for the higher molecular weight polymer to be present in stoichiometric excess.

In one particularly preferred process the anionic polymer is added to the coacervating mixture in the form of the ammonium, or low alkyl amine, salt. After the coacervation has taken place, ammonia or the amine is removed by volatilisation to reduce the pH, render the polymer less soluble in its environment and thus to render the final product more storage stable.

The product, that is the coated particles including a core of a bleach component, may be recovered in a variety of ways. In some instances the product suspension may be used as such, for instance by direct incorporation into a liquid detergent. Where the continuous phases of the product suspension and of the final liquid detergent are miscible with one another, the particles will remain suspended in the mixed continuous phase. Where the continuous phase of the product is immiscible with the continuous phase of the liquid detergent, the product may be dispersed as droplets in the liquid detergent, the droplets in turn containing particles of the bleach component in dispersed form.

Sometimes it may be desirable to remove some or all of the liquid in the dispersed phase of the product and/or of the continuous phase of the product. This may be done, for instance, by distilling under reduced pressure, which may produce a mixture of the two liquids, sometimes as an azeotrope. The dry product dispersion can then be incorporated direct into a liquid detergent. Alternatively the particles of coated bleach compound may be recovered as a solid particulate material, for instance by filtering them out of the dispersion or, usually, by centrifugation and subsequent solvent removal, for instance in a fluidised bed drier.

In a preferred method for carrying out the process of the present invention bleach component particles are suspended at a concentration of at least 10% by weight, preferably at least 25 or even at least 35% by weight in an aqueous solution containing a base polymer which is preferably a polyacrylate polymer. Preferably the concentration of base polymer in the aqueous solution will be at least 10% by weight, or even 25% by weight. The solution is stirred into a water-immiscible solvent, preferably a paraffinic oil and preferably in the presence of a water-in-oil emulsifier and an amphipathic polymeric stabiliser. Sufficient shear is applied to form a stable emulsion in the oil of particles having a size below 3 um and consisting of the aqueous blend of polymer and activator.

The emulsion is then subjected to drying to remove water from the aqueous dispersed phase, generally by azeotropic distillation under reduced pressure such that the maximum temperature in the emulsion does not exceed about 50° C., and results in a dispersion in the oil of substantially dry particles having a size below 3 $\mu$m, often below 1 $\mu$m, each consisting of a matrix of water soluble polymer, mainly in the free acid form, throughout which the activator is uniformly distributed.

A solution of the secondary polymer, which will form coacervate with the base polymer is also prepared. Preferably the secondary polymer comprises an aqueous solution comprising acrylamide/sodium acrylate polymer and/or urea/formaldehyde polymer. In a particularly preferred process the solution comprises 168 g 20% aqueous acrylamide/sodium acrylate polymer dissolved in 600 g water and 76 g of 35% aqueous solution of urea/formaldehyde resin in 100 g water which are added to one another over a period of 20 seconds while stirring with a Silverson stirrer, stirring then being continued for a further 30 seconds. At least 120 g of the dispersion in paraffinic oil is then stirred into this solution to form a white emulsion.

In a particular embodiment of the invention the polymeric coating comprises a mixture of a) neutralised polyacrylates containing a propionic acid-based repeating unit:

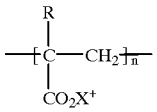

where each X is selected from Na, K, $NH_4$, $NH_2CH_2CH_2$ and H; R is $CH_3$ or preferably H: and n is chosen to give a maximum molecular weight of 100,000 and a polyacrylamide:

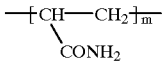

where m is chosen to give a molecular weight greater than 300,000.

This dispersion is suitable for stirring directly into a conventional high surfactant, eg. at least 25% or even at least 30 or even at least 35 or 40% by weight surfactant, high electrolyte, low water domestic laundry detergent containing hydrogen peroxide in continuous phase to form a dispersion of the substantially individually polymer particles in the detergent. These particles may remain substantially stable during storage but on dilution with water the polymer will dissolve to expose the activator to reaction with peroxide in the detergent.

The liquid detergent into which the product is included is generally an aqueous based liquid. Where the bleach component which is encapsulated in the invention is a bleach activator, the liquid detergent generally contains a bleach precursor. The bleach precursor may itself be in encapsulated form (for instance made by a process according to the present invention) or may be dissolved or dispersed as a solid in the aqueous detergent. Preferably the bleach precursor is hydrogen peroxide itself in solution.

The polymeric coating is resistant to hydrogen peroxide in that it increases the stability of the composition by reducing reaction between the encapsulated material and hydrogen peroxide.

On entry into a washing liquid, by dilution of the liquid detergent with aqueous wash liquor, the encapsulated coating is removable permitting release of the encapsulated material, for reaction with hydrogen peroxide where necessary. Generally, the pH in the washing liquid will be at least pH 7 or even at least pH 7.5 or 8.

The liquid detergent is usually a laundry detergent. It may, however, be a hard surface cleaner, for instance for domestic or institutional use. It may be a biocidal formulation, for instance for sterilising surfaces or equipment in hospitals. It may be a bleaching composition, for bleaching textiles during their manufacture. Other applications of the bleaching product are in water, effluent or sewage treatment, as a biocide, in pulp and paper bleaching, as an agricultural/water cultural biocide/fungicide/bactericide, as a contact lens disinfectant or general disinfectant.

The composition preferably contains other ingredients suitable for the end use. The detergent/bleaching composition may contain all the ingredients necessary as a complete concentrate, or two or more compositions may be added to an aqueous liquid to form the detergent or bleaching liquor.

For detergent compositions the liquid detergent will, for instance, contain builders, surfactants, enzymes, bleach stabilisers, bleach catalysts, abrasives, disinfectants, buffers, perfumes, and/or inorganic salts.

The following examples illustrate the invention.

EXAMPLES

Example 1

50 g TAED particles having an average particle size of 10 $\mu$m is dispersed in 400 g of a 10% solution of a base polyacrylate polymer, Sokalan CP45™ (BAS), with stirring. The dispersion is then spray dried to produce particulate solids of TAED and polyacrylate.

These particulate solids form a dispersed phase and are added to an aqueous solution of secondary polymer comprising 151 g of 20% aqueous acrylamide/sodium acrylate copolymer Alcapsol 144™ (Allied Colloids) dissolved in 540 g water and 38.6 g of a 62% urea/formaldehyde resin UFV62™ (Blagden Chemicals) dissolved in 30 g deionised water, the two having been added together over a period of 20 seconds whilst stirring with a Silverson stirrer, stirring then having been continued for a further 30 seconds. The weight ratio of acrylamide/acrylate copolymer to urea/formaldehyde resin is approximately 5:4 in the secondary polymer solution.

The solid particles comprising TAED are added to the secondary polymer solution at a weight ratio of solid particles comprising TAED to secondary polymer solution of approximately 1:2. The dispersed phase of TAED containing particles is then stirred into the solution and coacervation occurs.

Performance tests are carried out on the encapsulated TAED (coacervate) in the product, by testing the stability of the TAED in a peroxide-containing heavy duty liquid detergent (HDLD).

First, the weight percentage TAED in the coacervate produced is ascertained.

Determination of Weight % TAED in the Coacervate

The coacervate is dissolved in a suitable solvent eg acetonitrile (water may sometimes be used in conjunction with an organic solvent depending on the nature of the coacervate). In order to ensure total TAED extraction the sample is placed in sonic bath for several minutes. Residual solids (undissolved polymer coating) are filtered out. The resulting TAED solution is then passed through an HPLC column. The percentage TAED is determined by comparing peak areas with pre-run TAED standards.

Stability Testing in HDLD

Stability testing is then carried out. The appropriate quantity of coacervate is selected to result in 4% by weight TAED in the HDLD composition. For all tests, the same HDLD liquid and mass of HDLD was used for comparative purposes.

In this method the amount of peracid generated in the heavy duty liquid detergent (HDLD) is measured by performing an iodometric titration over ice and glacial acetic acid. The procedure is as follows:

Sample Preparation

A known amount of coacervate containing an amount of TAED determined by HPLC to provide 4% by weight based on the total weight of composition is added to a known mass of HDLD at pH 9.5. The sample is stirred for two minutes to ensure complete dispersion. A titration is then performed 1 hour later to determine the percentage peracid of the theoretical maximum generated within the liquid.

Titration

The titration is performed by adding a handful of ice, glacial acetic acid (15 ml) and potassium iodide (5 ml 10% by weight) into a 250 ml conical flask. Approximately 1 g HDLD was accurately weighed into a plastic weighing boat. The contents are then flushed into the conical flask with deionised water. A titration is then performed with sodium thiosulphate (0.05 M) until the solution turns a pale straw colour. Starch solution (Vitex) is then added and the titration is then continued until the blue/black colour indicating iodine, disappears.

A blank titration on the HDLD only is also performed to determine the background titre obtained from the peroxide. The amount of peracid of the theoretical maximum which is generated can then be determined.

Results

The results for example 1 are given in table 1. % PAA indicates the percent peracid of the theoretical maximum, lowest amounts indicating best results as they show a large proportion of unreacted hydrogen peroxide therefore indicating good stability within the composition.

Example 2

TAED particles are suspended at 40% by weight in aqueous solution containing 12% by weight low molecular weight (<100000) polyacrylate (base polymer) Vinamul 4025™ ((alkali soluble polyacrylate from Vinamul). This solution is stirred into MDC, (although a paraffinic oil such as toluene may be used.) In this example no emulsifying system is incorporated, an emulsion being formed by high shear mixing, but if desired, the solution is stirred into water immiscible phase in the presence of a water-in-oil emulsifier and an amphipathic polymeric stabiliser. Sufficient shear is used to form an emulsion in oil of particles consisting of the aqueous blend of polymer and activator. The weight ratio of MDC to aqueous phase is 2:1.

The emulsion is then subjected to azeotropic distillation under reduced pressure (686 mm water (6.72 $kP_a$)) such that the maximum temperature of the emulsion does not exceed about 80° C., and results in a gel-like dispersion in oil of substantially dry particles each consisting of a matrix of water soluble polymer, mainly in the free acid form, throughout which the activator is distributed.

A solution of secondary polymer is then prepared: 108 g 15% polyvinyl pyrrolidine, 108 g of the dispersion in oil is then stirred into this solution to form a creamy white gel or solid emulsion. Stirring using a Silverson stirrer takes place for approximately 30 minutes.

This dispersion may be stirred gently into a conventional high-surfactant, high electrolyte, low water domestic laundry detergent containing hydrogen peroxide in the continuous phase to form a dispersion of the substantially individual polymer activator particles in the detergent. These particles may remain substantially stable during storage but upon dilution with water the polymer dissolves to expose the activator to reaction with peroxide in the detergent liquor.

Performance testing was carried out.

Example 3 and Comparative Example A

In example 3, example 2 is repeated but replacing the base polymer Vinamul 4025™, with Vinamul 43375 (an acrylic polymer from Vinamul having m.wt. approximately 100000).

Comparative Example A incorporating unencapsulated TAED was also carried out. (™ denotes trade mark).

As will be seen from the results in table 1, compared with comparative example A the encapsulated bleach activators of examples 1–3 show significant stability benefits.

Example 4

200 g particulate TAED (having particle size on average 10 $\mu$m) is dispersed in 400–500 g dichloromethane (MDC) solvent to produce a white emulsion, since TAED is only partially soluble in MDC.

Separately, gelatin is dissolved in water to produce a 10% by weight aqueous solution of base polymer.

In a further separate step, a polyacrylate polymer (gum arabic) is dissolved (or dispersed) in water to provide a 10% by weight aqueous solution or dispersion of secondary polymer.

The aqueous solution of gelatin is added to the dispersion of TAED in MDC solvent with stirring using a high shear mixer. The mixture is stirred for approximately 30 minutes producing an oil-in-water emulsion.

The aqueous solution dispersion of polyacrylate is then added to the oil-in-water emulsion, with stirring using a high shear mixer. Stirring is continued but under mild heating, until the temperature of the emulsion reaches approximately 40° C. Deionised water is then added to produce a reaction mixture having a solids content of approximately 5% by weight. While adding the deionised water, the mixture is continuously stirred. Dilute acetic acid (other organic acids are also suitable) is then added to reduce the reaction pH from 6–7, to below 5.

The emulsion is then cooled to 5° C. in an ice bath. At this point a fine suspension of particles forms indicating the formation of the coacervate.

The particles are then hardened by the addition of high molecular weight polyelectrolyte as a deflocculating agent: carboxy methyl cellulose (CMC), in an amount to provide 3% by weight of the solids content of the emulsion. Formaldehyde is then added at a weight ratio of 1:10 formaldehyde to total polymer (base and secondary polymer).

Although formaldehyde is used in this example, any short chain aldehyde or any other crosslinking agent could be used to terminate the polymerisation of gelatin and gum arabic.

The reaction pH is then raised to approximately 10 by the addition of a 10% by weight aqueous solution of sodium hydroxide. The sodium hydroxide solution is added gradually at a rate of approximately 2–3 ml per minute, to minimise particle flocculation. The microcapsules produced are then isolated by azeotropic distillation to produce a dry particulate white powder.

Example 5

Example 4 was repeated, but replacing the gum arabic secondary polymer with a different polyacrylate Vinamul 7170 (a 50:50 copolymer of styrene-butyl acrylate with molecular weight>100000, from Vinamul), as noted in table 2.

The percentage by weight TAED and percent peracid of the theoretical maximum, generated over one hour were calculated as described above. Results are given in Table 1.

Example 6

25 g cationic urea formaldehyde pre-condensate and 63 g acrylate/acrylamide co-polymer are formed into an aqueous solution in 220 g water. 200 g TAED in 620 g MDC is then added, with mixing using Silverson mixer at speed 4 for 25 minutes. The mixture comprising TAED and base polymer is then cooled to 10° C.

Subsequently 16 g methylated melamine formaldehyde pre-condensate in 369 g water are added to the mixture to form the secondary polymer, with stirring. During stirring, 1.2 g acetic acid is added to adjust the pH to 4.7. The temperature of the mixture is then raised to 55° C. using a water bath, with stirring at 1300 rpm for 1.75 hours. The mixture is then cooled to ambient temperature with stirring for 12–24 hours. The pH of the cooled mixture was raised to pH 10 by the addition of a 10% by weight aqueous solution of sodium hydroxide to produce an emulsion. The product is isolated using a toluene azeotrope of the MDC, although centrifugation and filtration techniques have also been found to be useful.

The test described above to determine the percentage by weight TAED in the product was carried out. The appropriate amount of product was selected to provide 4% by weight TAED in the HDLD for performance testing. The results for PAA are given in Table 1. Again, the considerable stability benefits using the encapsulation of the present invention can be seen from the result.

TABLE 1

| Example | Base Polymer | Solvent | Secondary Polymer | TAED (% by weight) | % PAA |
|---|---|---|---|---|---|
| A | Uncoated | | | 100 | 59 |
| 1 | Sokalan CP45 | — | UFP62 Alcapsol 144 | 25 | 9 |

TABLE 1-continued

| Example | Base Polymer | Solvent | Secondary Polymer | TAED (% by weight) | % PAA |
|---|---|---|---|---|---|
| 2 | Vinamul 4025 | MDC | PVP K30 | 80 | 5 |
| 3 | Vinamul 43375 | MDC | PVP K30 | 80 | 7 |
| 4 | Gelatin | MDC | Gum Arabic | 81 | 27 |
| 5 | Gelatin | MDC | Vinamul 7170 | 79 | 20 |
| 6 | Vinamul 43375 | MDC | UFP63 | 76 | 27 |

We claim:

1. A process for making a polymeric coated peroxygen bleach component having a solid core containing particles of said peroxygen bleach component including the steps of:

(i) dispersing a solid peroxygen bleach component in a continuous liquid phase to form discrete islands of dispersed phase containing said bleach component;

(ii) forming a polymeric coating at the interface between the said dispersed phase and the continuous phase by coacervation from a mixture of (a) neutralized polyacrylates containing a propionic acid-based repeating unit:

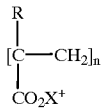

wherein each X is selected from the group consisting of Na, K, $NH_4$, $NH_2CH_2CH_2$ and H; R is $CH_3$ or H; and n is chosen to give a maximum molecular weight of 100,000 and (b) a polyacrylamide:

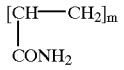

wherein m is chosen to give a molecular weight greater than 300,000.

2. A process according to claim 1 in which the polymer coating formed from said mixture includes a crosslinker.

3. A process according to claim 2 in which the crosslinker is selected from the group consisting of urea, melamine, formaldehyde, urea formaldehyde and melamine formaldehyde resins.

4. A process according to claim 2 in which the crosslinker is polyvinyl pyrrolidone.

5. A process for preparing a core of solid particles of tetraacetyl ethylene diamine (TAED) bleach component encompassed by a protective polymeric coating which comprises:

(a) providing a first aqueous liquid composition containing a base polymer;

(b) dispersing TAED particles into the said first aqueous liquid composition to form a TAED-containing aqueous liquid composition;

(c) mixing the TAED-containing aqueous liquid composition into a water-immiscible solvent to form a water-in-oil emulsion;

(d) removing water from the water-in-oil emulsion by distillation to form a dispersion of base polymer and TAED in solvent;

(e) providing an aqueous solution of a secondary polymer capable of forming a coacervate with the said base polymer;

(f) admixing the dispersion of base polymer and TAED in solvent with the said aqueous solution of a secondary polymer, to form an oil-in-water emulsion comprising islands of water-immiscible dispersed phase in aqueous continuous phase in which the TAED is in the dispersed phase islands, and coacervating the said base polymer and said secondary polymer to form a polymeric coating around said islands, said polymer of the coating being selected such that it is resistant to hydrogen peroxide and is removable by aqueous wash liquor; and g) removing the solvent by distillation to form an aqueous dispersion of polymer-coated TAED product.

6. A process according to claim 5 comprising the further step:

h) the aqueous dispersion of polymer-coated TAED product is combined with aqueous hydrogen peroxide.

7. A process according to claim 5 in which the water-immiscible solvent is methylene dichloride.

8. A process for making polymer-coated tetracetyl ethylene diamine (TAED) comprising the steps:

a) dispersing TAED particles into a water-immiscible solvent;

b) providing an aqueous solution containing a base polymer;

c) providing an aqueous solution of a secondary polymer capable of forming a coacervate with the base polymer;

d) mixing the product of step a) with the product of step b) to form an intermediate oil-in-water emulsion;

e) mixing the intermediate oil-in-water emulsion with the product of step c) to form a final oil-in-water emulsion;

f) coacervating at the interface of the final emulsion to form polymer-coated TAED dispersed in an aqueous phase; and g) removing the water-immiscible solvent from the TAED dispersion in aqueous phase by distillation to form an aqueous dispersion of polymer coated TAED product of which the polymer coating is resistant to hydrogen peroxide and is removable by aqueous wash liquor.

9. A process according to claim 8 comprising the further step h) the aqueous dispersion of polymer-coated TAED product is combined with aqueous hydrogen peroxide.

10. A process according to claim 8 in which the water-immiscible solvent is methylene dichloride.

* * * * *